US009233457B2

(12) United States Patent
Wanek et al.

(10) Patent No.: US 9,233,457 B2
(45) Date of Patent: Jan. 12, 2016

(54) CONTROL DEVICE FOR A HAND-HELD POWER TOOL

(75) Inventors: Helmut Wanek, Kirchheim/Neckar (DE); Thomas Gabriel, Kirchheim-Jesingen (DE)

(73) Assignee: Robert Bosch GmbH, Stuttgart, DE (US)

( * ) Notice: Subject to any disclaimer, the term of this patent is extended or adjusted under 35 U.S.C. 154(b) by 833 days.

(21) Appl. No.: 13/513,374

(22) PCT Filed: Nov. 4, 2010

(86) PCT No.: PCT/EP2010/066802

§ 371 (c)(1),
(2), (4) Date: Aug. 27, 2012

(87) PCT Pub. No.: WO2011/067066

PCT Pub. Date: Jun. 9, 2011

(65) Prior Publication Data

US 2012/0312570 A1 Dec. 13, 2012

(30) Foreign Application Priority Data

Dec. 3, 2009 (DE) ..... 10 2009 047 443

(51) Int. Cl.

| | |
|---|---|
| ***B25F 5/00*** | (2006.01) |
| ***B25B 23/14*** | (2006.01) |
| ***B25B 23/147*** | (2006.01) |
| ***B25B 21/00*** | (2006.01) |

(52) U.S. Cl.

CPC ..... *B25B 21/00* (2013.01); *B25B 23/141* (2013.01); *B25B 23/147* (2013.01); *B25F 5/00* (2013.01)

(58) Field of Classification Search

CPC ..... B25F 5/00; B25B 23/14; B25B 23/147
USPC ..... 173/1, 2, 11, 176, 20
See application file for complete search history.

(56) References Cited

U.S. PATENT DOCUMENTS

| | | | | |
|---|---|---|---|---|
| 6,571,179 | B2 * | 5/2003 | Siegel | 702/33 |
| 2008/0230245 | A1 * | 9/2008 | Matsunaga | 173/4 |

FOREIGN PATENT DOCUMENTS

| | | | |
|---|---|---|---|
| CN | 201020689 | Y | 2/2008 |
| CN | 101224571 | A | 7/2008 |
| CN | 101253015 | A | 8/2008 |

(Continued)

OTHER PUBLICATIONS

International Search Report corresponding to PCT Application No. PCT/EP2010/066802, mailed Jan. 21, 2011 (German and English language document) (7 pages).

*Primary Examiner* — Michelle Lopez
(74) *Attorney, Agent, or Firm* — Maginot, Moore & Beck LLP

(57) ABSTRACT

A hand-held power tool, in particular to a screwing device, includes a control device for controlling and/or regulating the tool movement of a tool holder and/or of a tool. The hand-held power tool has an interface for communicating with an external adjustment device. The interface is configured to be connected to the control device in such a way that signals may be transmitted for the parameterization of at least one tool movement sequence. The tool movement sequence includes a plurality of sequentially-progressing tool movements. A method for parameterizing at least one tool movement sequence of a hand-held power tool includes parameterizing the at least one tool movement sequence with a separate setting device in a remote-controlled manner via an interface of the hand-held power.

15 Claims, 1 Drawing Sheet

(56) References Cited

FOREIGN PATENT DOCUMENTS

| | | | |
|---|---|---|---|
| DE | 199 61 374 | A1 | 6/2001 |
| DE | 101 27 821 | C1 | 7/2002 |
| DE | 10 2005 056 264 | A1 | 5/2007 |
| DE | 10 2008 061 495 | A1 | 6/2010 |
| EP | 1 724 065 | A1 | 11/2006 |
| JP | 2008-213068 | A | 9/2008 |
| WO | 2010066375 | A1 | 6/2010 |

* cited by examiner

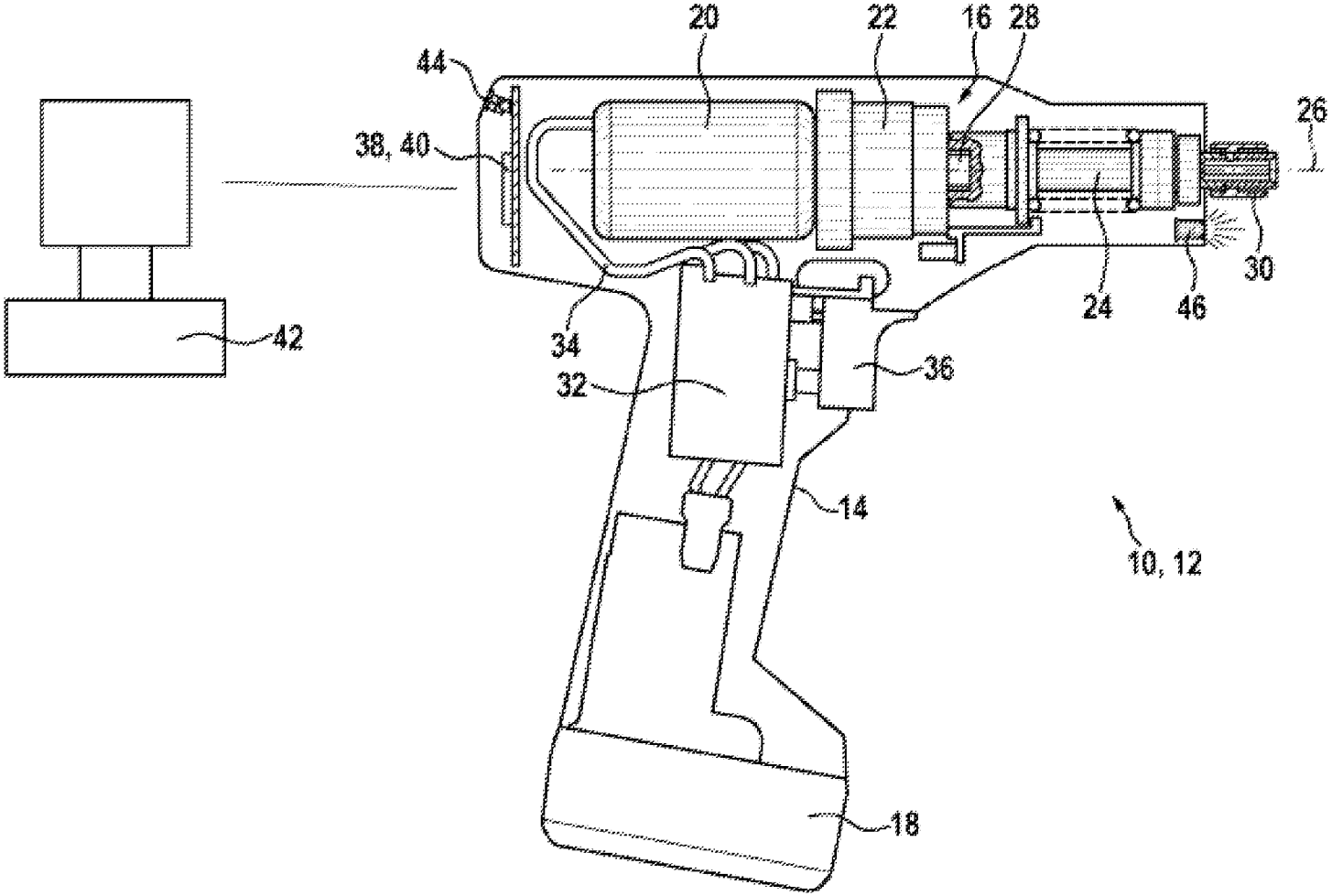
26
30
46
24
28
16
22
20
44
38, 40
42
34
32
36
14
18
10, 12

CONTROL DEVICE FOR A HAND-HELD POWER TOOL

This application is a 35 U.S.C. §371 National Stage Application of PCT/EP2010/066802, filed on Nov. 4, 2010, which claims the benefit of priority to Serial No. DE 10 2009 047 443.9, filed on Dec. 3, 2009 in Germany, the disclosures of which are incorporated herein by reference in their entirety.

BACKGROUND

The disclosure relates to a hand-held power tool, in particular a screwing device, having a control device for subjecting the tool movement of a tool holder and/or of a tool to open-loop control and/or closed-loop control.

A hand-held power tool of this kind in the form of a screwing device having a control device for controlling the rotation speed of a tool holder or of a tool which is held in said tool holder is known from DE 2005 056 264 A1.

A screwing device of this kind is suitable both for rapidly screwing screws and for tightening screw connections with a predetermined torque. Therefore,—as a combination of these properties—the screw can be screwed rapidly at the beginning of the screwing operation and a tightening torque which is as accurate as possible can be achieved at the end of the screwing operation. To this end, successively different rotation speed stages can be set as a function of the rotation speed, with a regulation device using a value which is derived from the rotation speed as a triggering parameter for changing the rotation speed.

Regulation of the tool operating variable—specifically the rotation speed of the tool, that is to say a tool (angular) speed—results in a high level of expenditure on measurement and regulation.

SUMMARY

The hand-held power tool according to the disclosure offers the advantage of providing a low-cost and easy-to-operate machine for quick and precise screwing, in particular for screwing processes which are already known.

For this purpose, the hand-held power tool according to the disclosure has an interface for communicating with an external setting device, with the interface being connected for signaling purposes to the control device in order to parameterize at least one tool movement sequence which comprises a plurality of sequential tool movements. A tool movement sequence is to be understood to mean a sequence of tool movements which are prespecified or can be prespecified by corresponding parameters. The prespecification of the parameters which determine the movement sequence is the parameterization. This parameterization according to the disclosure of the tool movement sequence is not performed directly at the hand-held power tool but rather by means of a setting device which is external to the tool. In this case, the setting device has, in particular, a computation device (computer).

The tool movements of a tool movement sequence of a hand-held power tool which is in the form of a screwing device are, in particular, so-called screwing stages.

The following advantages are achieved:

- reduction in the manufacturing times by accelerating the screwing processes using extremely simple means,
- option of integrating worker guidance, that is to say, for example, assisting control by the operator for a prespecified screwing order and/or number of screw connections, and

- option of using an only crude regulation device for regulating tool operating variables or dispensing with such regulation entirely.

In screwing processes which are already known, the hand-held power tool assists the person operating it since it already "knows" the sequence (worker guidance or worker assistance). The interface is preferably also connected for signaling purposes to the control device in order to set a tool operating variable.

According to a preferred refinement of the disclosure, the interface is an air interface for cable-free parameterization by means of the external setting device. Complicated and impractical cable connection can be dispensed with on account of the air interface. The air interface is, in particular, a radio interface or an infrared interface. Said air interface connects the hand-held power tool to a corresponding air interface of the setting device in a cable-free manner.

According to an advantageous development of the disclosure, provision is made for the hand-held power tool to have a drive device for generating the tool movement, with the control device being connected for signaling purposes to the drive device in order to subject the tool movement sequence to open-loop control and/or closed-loop control. The tool movement sequence, that is to say the sequence of tool movements, can be subjected to both open-loop control and closed-loop control by the control device.

According to a further advantageous development of the disclosure, provision is made for the control device and the drive device to be connected for signaling purposes to the drive device in a regulator-free system in order to control at least one tool operating variable. In this context, "regulator-free system" means that—even when there is a signal line, which runs from the drive device to the control device, in order to feed back the corresponding tool operating variable—no control loop for closed-loop control of this tool operating variable is produced since there is no regulator which assesses or compares the deviation in the fed back variable from a guide variable for ascertaining an actuating variable. Therefore, the control device merely controls the tool operating variable(s), it being possible to dispense with complicated measurement and regulation devices. However, signals of the tool operating variables which are fed back to the control device are used in particular as "trigger signals" for determining a time within the tool movement sequence, that is to say only for the parameterization thereof.

The complicated regulation of tool operating variables is dispensed with in this exemplary embodiment.

In this case, the trigger signals can be produced from tool operating variables. The time determined by the trigger signal results, in particular, in a time at which a change is made between two tool movements or a time of the end of the tool movement sequence.

Provision is particularly made for the tool operating variable to be a position and/or a movement direction and/or a speed and/or an acceleration of the tool. The position, movement direction, speed and acceleration of the tool and/or of the tool holder are tool movement variables. These tool movement variables are, in particular, rotary movement variables (tool rotary movement variables), that is to say an angular position and/or an angular speed and/or an angular acceleration.

As an alternative or in addition, provision is advantageously made for the tool operation variable to be a disconnection force and/or a disconnection torque of the tool. These tool operating variables can be set, in particular, by means of a clutch which is in the form of a disconnection clutch.

A further tool operating variable is an instantaneous current intensity of the current to be supplied to the drive device.

According to an advantageous development of the disclosure, provision is made for the hand-held power tool to have a clutch which is interconnected between the output drive of the electrical machine and the tool and/or the tool holder, with the control device being connected for signaling purposes to the clutch in order to subject the tool movement sequence to open-loop control and/or closed-loop control. The clutch is, in particular, a disconnection clutch.

According to a further advantageous development of the disclosure, provision is made for the hand-held power tool to have at least one operating element for operating the hand-held power tool and/or for selecting one of the tool movement sequences and/or one of the tool operating variables. The operating element is, in particular, connected for signaling purposes to the control device. The operating element preferably also serves to operate the hand-held power tool.

The disclosure also relates to a method for parameterizing at least one tool movement sequence, which comprises a plurality of sequential tool movements, of a hand-held power tool, in particular a screwing device, with the parameterization being performed by means of a separate setting device in a remote-controlled manner via an interface of the hand-held power tool. A tool movement sequence is to be understood to mean a sequence of tool movements which are prespecified or can be prespecified by corresponding parameters. The prespecification of the parameters which determine the movement sequence is the parameterization. This parameterization is not performed directly at the hand-held power tool but rather by means of a setting device which is external to the tool. In this case, the setting device has, in particular, a computation device.

The parameterization is performed, in particular, by means of the separate setting device in a cable-free manner via an air interface of the hand-held power tool.

Provision is advantageously made for at least one tool operating variable to be used as "trigger signals" for determining a time within the tool movement sequence. This tool operating variable is preferably only actuated. Therefore, a corresponding control device of the hand-held power tool only controls the tool operating variable(s), it being possible to dispense with complicated measurement and regulation devices. However, signals of the tool operating variables which are fed back to the control device are used, in particular, as "trigger signals" for determining a time within the tool movement sequence, that is to say only for the parameterization thereof. In this case, these trigger signals can be produced from tool operating variables.

Provision is particularly made for the tool operating variable to be a position and/or a movement direction and/or a speed and/or an acceleration of the tool. The position, movement direction, speed and acceleration of the tool and/or of the tool holder are tool movement variables. These tool movement variables are, in particular, rotary movement variables (tool rotary movement variables), that is to say an angular position and/or an angular speed and/or an angular acceleration. As an alternative or in addition, provision is advantageously made for the tool operating variable to be a disconnection force and/or a disconnection torque of the tool. These tool operating variables can be set, in particular, by means of a clutch which is in the form of a disconnection clutch. A further tool operating variable is an instantaneous current intensity of the current to be supplied to the drive device.

BRIEF DESCRIPTION OF THE DRAWING

The disclosure will be explained in greater detail below with reference to the drawing of an exemplary embodiment, in which the FIGURE shows a system according to the disclosure having a setting device and a hand-held power tool.

DETAILED DESCRIPTION

The FIGURE shows a hand-held power tool 12 which is in the form of a screwing device 10. The screwing device is in the form of a pistol and has a housing 14 which is subdivided into a main part for accommodating a drive device 16 and into a handle part which has a rechargeable battery module 18 accommodated in a replaceable manner at its lower end. The hand-held power tool 12 is therefore in the form of a rechargeable battery-operated electric hand-held power tool, to be precise a rechargeable battery-operated screwdriver. The drive device 16 of the hand-held power tool 12 has an electrical machine 20 which is in the form of an electric motor, a gear mechanism 22 which is connected downstream, and a clutch 24 which is in the form of a disconnection clutch (slipping clutch) and, for its part, is connected downstream of the gear mechanism 22.

As an alternative to the pistol-like design of the screwing device 10, said screwing device can also be in the form of a rod-like screwing device or a screwing device with an angular design.

The electrical machine 20 which is in the form of an electric motor, the gear mechanism 22 and the clutch 24 are arranged along a drive axis 26, with the output drive of a corresponding drive shaft 28 projecting out of the housing 14 at an end of the housing 14 for driving a tool holder 30 which is arranged outside the housing 14. The tool holder 30 serves to hold the tool (not shown here) which is a screwdriver bit in the case of a screwing device 10. The electrical machine 20 drives the tool holder 30 via the downstream gear mechanism 22 and the clutch 24 which is connected downstream of the gear mechanism 22.

The at least one tool operating variable, in particular the tool movement variable which determines the tool movement or the movement of the tool holder 30, is controlled by means of a control device 32. The control device 32 and the drive device 16 are connected for signaling purposes to the drive device 16 in order to control the at least one tool operating variable in a regulator-free system. The control device 32 has a computation device (CPU) and a data memory device (not shown). It goes without saying that the at least one tool operating variable can also be controlled by means of a first control device and the tool movement sequence can be subjected to open-loop control and/or closed-loop control by a second control device.

The lines 34 for this signaling connection connect the control device 32 to the electrical machine 20, preferably also to the clutch 24 and, in particular, also to the gear mechanism 22.

The hand-held power tool 12 also has an operating element 36 for operating the hand-held power tool 12. The operating element 36 is additionally also used to select tool operating variables (rotation speed of the tool and/or whether said tool rotates clockwise or counterclockwise). The operating element 36 is connected for signaling purposes to the control device 32. In the exemplary embodiment in the FIGURE, the control device 32 and the operating element 36 form a unit.

The hand-held power tool 12 also has an interface 40, which is in the form of an air interface 38, for communicating with an external setting device 42, with the interface 40 being connected for signaling purposes to the control device 32 by means of a further line (not shown) in order to parameterize at least one tool movement sequence and/or to set at least one tool operating variable. The interface 40 is also connected to a signaling device 44 of the hand-held power tool 12. The signaling device 44 provides the user of the hand-held power tool 12 with, for example, information relating to data transmission between the setting device 42 and the hand-held power tool 12 and/or about which movement sequence is currently parameterized.

The resulting system comprising the setting device 42 and the hand-held power tool 12 makes it possible to carry out a method for parameterizing at least one tool movement sequence and/or for setting at least one tool function of the hand-held power tool 12, with the parameterization and/or setting being performed by means of the separate setting device in a remote-controlled manner via the interface 40 of the hand-held power tool 12.

The tool movement sequence of a screwdriver device 12 can be, for example, a screwing task with several screwdriving operations which are to be matched to one another. A screwdriving task of this kind can be performed, for example, at manufacturing stations for complex assembly (for example in automobile construction).

The system has the following advantages:

extremely simple setting/parameterization, with the use of air interfaces 38, without complicated cable connections;

executing process-critical screwing operations with the cost-effective alternative of a screwing device 10 which is in the form of a shut-off nut setter (with the extremely simple means of a shut-off nut setter);

increasing the process reliability of shut-off nut setters and reducing manufacturing times;

monitoring function for screwdriving tasks (several individual screwing operations) without system connection (superordinate process control computer) in an extremely simple manner;

allowing worker guidance or worker assistance;

no active regulation with complicated measurement and regulation is required in order to set the tool operating variables, but rather only adjustability is required, in particular by means of pulse-wave modulation.

The following options are provided for advantageous refinements:

setting/parameterization is performed in a cable-free manner (for example by means of radio);

option of adjustable repetition protection (for example by deactivating the switch-on function of the screwing device 10 after a screwing operation to prevent double hits);

switching-on and switching-off a working position illumination means 46;

definition of the signaling devices 44 on the hand-held power tool 12 (for example as an LED and/or buzzer and/or display);

option of extremely simple changeover to screws/nuts with a left-handed or right-handed thread;

option of blocking counterclockwise or clockwise rotation (blocking one of the movement directions);

use as an extended "OK criterion" of the disconnection signal of the clutch 24 which is in the form of a mechanical disconnection clutch (time, angle, number of revolutions, reaching a specific screwdriving stage);

a ramp of the change in rotation speed is permanently programmed, also for safety reasons (worker protection), automatic pause function when the direction of rotation changes (worker protection);

monitoring function for screwdriving tasks (several individual screwing operations) without system connection (superordinate process control computer) in an extremely simple manner; and multi-stage (1 to n-stage) screwdriving method in the case of a shut-off nut setter (for example comprising the following screwdriving stages: threading stage, then rapid screwing, then slow final tightening) by means of the following trigger functions:

1.) disconnection signal of the mechanical disconnection clutch as a trigger for the changeover to a new screwdriving stage;

2.) screwing time as a trigger for the changeover to a new screwdriving stage;

3.) number of revolutions (at the output drive) as a trigger for the changeover to a new screwdriving stage; and 4.) angle measurement as a trigger for the changeover to a new screwdriving stage.

The invention claimed is:

1. A hand-held power tool, comprising:

a portable hand-held housing;

a drive device accommodated in the housing;

one or more of a tool holder and a tool configured to be driven by the drive device, a control device accommodated in the housing and connected to the drive device, the control device being configured to control the drive device using one or more of open-loop control and closed-loop control so as to cause the drive device to drive the one or more of the tool holder and the tool to perform at least one tool movement sequence, the at least one tool movement sequence being defined by prespecified parameters, and an interface supported by the housing and configured to communicate with an external setting device, the interface being connected to the control device for signaling purposes, wherein the control device is configured to receive the prespecified parameters from the external setting device via the interface, wherein the at least one tool movement sequence comprises a plurality of sequential tool movements.

2. The hand-held power tool as claimed in claim 1, wherein the interface is an air interface configured for cable-free parameterization by the external setting device.

3. The hand-held power tool as claimed in claim 1, further comprising a drive device configured to generate the tool movement, the control device being connected to the drive device for signaling purposes and configured to subject the tool movement sequence to the one or more of open-loop control and closed-loop control.

4. The hand-held power tool as claimed in claim 3, wherein the drive device has an electrical machine which drives the one or more of the tool holder and the tool, the control device being connected to the electrical machine for signaling purposes and configured to subject the tool movement sequence to the one or more of open-loop control and closed-loop control.

5. The hand-held power tool as claimed in claim 4, further comprising a clutch which is interconnected between an output drive of the electrical machine and the one or more of the tool and the tool holder, the control device being connected to the clutch for signaling purposes and configured to subject the tool movement sequence to the one or more of open-loop control and closed-loop control.

6. The hand-held power tool as claimed in claim 1, wherein the control device and the drive device are connected for signaling purposes in a regulator-free system and configured to control at least one tool operating variable.

7. The hand-held power tool as claimed in claim 6, wherein the tool operating variable is one or more of a position, a movement direction, a speed, and an acceleration of the one or more of the tool and the tool holder.

8. The hand-held power tool as claimed in claim 6, wherein the tool operating variable is one or more of a disconnection force and a disconnection torque of the tool.

9. The hand-held power tool as claimed in claim 6, further comprising at least one operating element configured to select one of the one or more of the tool movement sequences and the tool operating variables.

10. The hand-held power tool as claimed in claim 1, further comprising at least one operating element configured to operate the hand-held power tool.

11. The hand-held power tool as claimed in claim 1, wherein the control device has a computation device (CPU) and a data memory device.

12. The hand-held power tool as claimed in claim 1, wherein the interface is connected for signal purposes to the control device by a further line in order to parameterize at least one tool movement sequence and/or to set at least one tool operating parameter.

13. The hand-held power tool as claimed in claim 12, wherein the interface is also connected to a signaling device accommodated by the portable hand-held housing, the signaling device being configured to provide a user of the hand-held power tool with information relating to data transmission between the external setting device and the hand-held power tool and/or about which movement sequence is currently parameterized.

14. The hand-held power tool as claimed in claim 1, wherein the interface is accommodated in the portable hand-held housing.

15. A method for parameterizing at least one tool movement sequence of a hand-held power tool, comprising:

parameterizing the at least one tool movement sequence for the power tool with an external setting device, the power tool including a portable hand-held housing in which a drive device and a control device for the power tool are accommodated, the external setting device being located externally with respect to the housing;

communicating the parameterized tool movement sequence to the control device via an interface on the power tool; and controlling the drive device to execute the parameterized tool movement sequence with the control device;

wherein the at least one tool movement sequence includes a plurality of sequential tool movements.

* * * * *